United States Patent [19]

Zöllner et al.

[11] 4,446,561

[45] May 1, 1984

[54] AXIALLY MOVABLE ELECTRODE HOLDER FOR USE IN ELECTRIC STEEL PRODUCTION

[75] Inventors: Dieter Zöllner, Schwaig/Nürnberg; Inge Lauterbach-Dammler, Nuremberg; Friedrich Rittmann, Rückersdorf/Nürnberg, all of Fed. Rep. of Germany

[73] Assignee: Arc Technologies Systems, Ltd., Cayman Islands

[21] Appl. No.: 411,896

[22] Filed: Aug. 26, 1982

[30] Foreign Application Priority Data

Sep. 10, 1981 [DE] Fed. Rep. of Germany ..... 3135960

[51] Int. Cl.[3] ..... H05B 7/101

[52] U.S. Cl. ..... 373/93

[58] Field of Search ..... 373/93, 101, 94, 100, 373/99

[56] References Cited

FOREIGN PATENT DOCUMENTS 2037549 7/1980 United Kingdom ..... 373/93

*Primary Examiner*—Roy N. Envall, Jr.

*Attorney, Agent, or Firm*—Woodrow W. Ban

[57] ABSTRACT

An axially movable electrode holder of metal, particularly copper or copper base alloy, for active parts of consumable or slowly consumable material, which are attachable by means a threaded nipple or a similar means. The electrode holder comprises a cooling unit with a supply and a return duct, and has at least partly, preferably its lower region, a protective coating and a contact arrangement on its sheath area by which the electrode holder may be connected to a current supply. The electrode holder further comprises a number of removably mounted electrical and/or mechanical contact moldings of pressure-resistant material extending over a length of the electrode holder which corresponds too at least a part of the length of an allowable tip consumption. The electrode holder, which is intended for use in the electric steel production, is characterized by a high reliability in service, good maneuverability, and good electrical properties.

19 Claims, 4 Drawing Figures

AXIALLY MOVABLE ELECTRODE HOLDER FOR USE IN ELECTRIC STEEL PRODUCTION

FIELD OF THE INVENTION

The invention relates to axially movable electrode holders of metal comprising a threaded nipple or similar means for attaching active electrode parts of consumable material to the electrode holder, and a cooling facility with a supply and a return pipe, and having a contact arrangement by which the electrode holder may be mechanically clamped by clamping jaws and electrically connected to a current supply.

BACKGROUND OF THE INVENTION

It is known that combination electrodes, which consist of an internally cooled electrode holder with an attached active part of carbon material, have been employed in electric-arc furnace operations for some time. The electrode holder of metal or alloys serves not only as mechanical fastener of the active part but also acts as current supply. DE-AS No. 24 30 817, the German document laid open to public inspection, describes e.g. an electrode for electric-arc furnaces which has an upper, internally cooled metal electrode holder that remains in the clamping jaw zone during operation. Electrode sections of graphite are screwed to its lower part. The current is supplied via clamping jaws enclosing the metal sheath area of the electrode holder. As the current supplying clamping jaws rest directly on the sheath area of the electrode holder, the electrode holder may be mechanically damaged. With cooling water pipes on the inside of sheath area, this danger is especially critical, for their damage may lead to a leak and, consequently, to the escape of water into the hot molten metal.

DE-AS No. 27 39 483 already describes electrodes for electric-arc furnaces of the type mentioned where the metal shaft of the electrode support holding the active part and a clamp inserted from the outside are connected by means of a metal-metal contact. With this type of design, the sheath area of the electrode holder constitutes the outer limit for the backflow of the cooling agent. Here, too, mechanical damage may as a result of the clamping force exerted by the clamping jaws supplying the current. As the current supply is based on a metal-metal contact, the metallic sheath area of the electrode holder is not protected against mechanical or electrical impairments such as arching, which is the reason why the electrode holder cannot be inserted into the interior of the electric-arc furnace. Depending on the dimensions of the electric-arc furnace, it is therefore necessary to attach relatively long active parts to the electrode holder, which leads to an increase in the consumption of active material. Furthermore, the manoeuvrability of the electrode within the electric-arc furnace is rather limited.

In its European patent application 80 106 583.0 the applicant already suggested to equip the outer sheath area of the electrode holder with intercalations which may be fastened by means of pocket mountings. Although such a contact zone at the upper end of the metal shaft with a length of approximately 0.2 m to 0.5 m has its advantages, it does not in all cases produce the flexibility when employing the electrode All these electrode holders have one disadvantage in common, that is, as the tip (the consumable active part) is consumed, the electrode holder has to be lowered to meet the positioning requirements concerning bath level respective scrap distribution.

For conventional electrodes, consisting of a column of e.g. graphite sections, which are screwed one by one on the top of the column as the lower parts are consumed, the range of control which had to be covered by the positioning means was restricted to the actual distance, over which the lower tip end had to be moved in order to be adjusted to the scrap or the bath level. The consumption of the electrode was compensated by feeding the endless electrode from the top and more or less continuously lowering the entire column. With the employment of combined electrodes consisting of a water cooled permanent upper section, the consumption of the tip has to be compensated by axial movement of the permanent section, as far as permitted by the range of the existing positioning means of the established arc furnaces. Since there must always be provided a certain range of axial movement for regulation purposes, only the relatively small difference between the entire range of the positioning means and the necessary control range is left to compensate the consumption of the active parts. When a length of the tip corresponding to that difference is consumed, a new section of graphite or the like has to be screwed onto the lower end of the electrode holder, which constitutes the permanent section.

OBJECT OF THE INVENTION

The object of the present invention is to create an improved electrode holder of the general type described supra, allowing the current to be supplied in a simple manner and fulfilling the criteria of extensive axial motility during electric-arc furnace operations as well as high reliability in service.

In particular, employing the electrode holder of the invention the user should be able to hold the internally cooled electrode holder without damaging the metal sheath area despite high clamping forces that may be required and be able to rely on its safety during operation.

A special object of the invention is to provide an electrode holder, which allows continued electrode operation without immediate necessity for adding a new active electrode part even when the existing active part positioned within the arc furnace is so far consumed, that the tip end can not reach optionally lowered positions in the arc-furnace any more. This problem is solved by a type of electrode holder as described previously, including an improvement characterized in that the contact arrangement comprises at least a highest and a lowest contact zone of pressure-resistant material, each contact zone having an axial dimension sufficient to receive the clamping jaws, whereby the distance between the highest and the lowest contact zone corresponds to at least a portion of an allowable length of consumption of the active electrode parts. The pressure-resistant material used in accordance with the invention is preferably graphite or graphite-containing composite materials. But it is also possible to use other pressure-resistant contact materials which, in addition to the criterion of excellent conductivity, also have the ability to resist high temperatures.

The term "contact zone" defines a possible current transition area having at least the same width as the fixing jaws of the clamping devices usually used for electric-arc furnace operations in the electric steel production and also employed as current supply.

The term "allowable length of consumption of the active electrode parts" defines the distance by which the electrode has to be moved into the electric-arc furnace in order to counterbalance the consumption of the active part, as far as it is consumable, except for a remaining "safety piece", often approximately 0.4 m to 0.7 m long, with the electric arc distance remaining about the same.

In accordance with a preferred embodiment of the invention, the electrode holder has at least two discrete contact zones set off one from the other. But it is also possible to provide a continuous sequence of contact zones.

The contact zones are rings, semi-bowls or segments of highly electrically conductive material which preferably abut on the metal sheath area, and the individual segments in turn may form rings. For example, three circular segments of approximately 120° or less of the circumferential ring forming the contact zone.

It is especially advantageous if the elements forming the contact zones, particularly the individual segments, snugly rest on the sheath area of the electrode. But it is also possible to have an additional, highly conductive, if necessary deformable material between the removable contact moldings and the metal sheath area which may serve as contact improver and, at the same time, as "buffer substance" to accommodate vibration of the electrode or mechanical stress.

In accordance with a preferred embodiment of the invention, the contact zones are arranged in the upper part of the sheath area of the electrode holder in such a way as to allow the current supply via the upper half of the electrode holder. A current supply via the upper half of the electrode holder would be especially preferable, in this case the contact zones are arranged in the upper half, i.e. they surround the upper half of the sheath area of the metal shaft in a continuous or discontinuous manner.

Contact segments of graphite which form two separate contact zones may be fastened in the following way: In the center of the two axially displaced contact zones there are fastening means, e.g. screws, which simultaneously hold the top and the bottom graphite segments, which, in turn, are additionally fastened by similar or different fastening means. If rings are used, consisting of three segments each, nine fastening elements will be required for six graphite contact segments. When using this type of embodiment of the invention, which is especially favourable, it is also possible to transform the two discrete contact zones or contact areas into one continuous fastening and contact zone. This may e.g. be achieved by putting conductive coverings on the fastening elements. In spite of segmented individual elements of limited length, it is thus possible to cover e.g. a length of 0.6 m to 2.5 m—the preferred length is 0.8 m to 1.8 m—in the upper part of the electrode holder in a continuous or semi-continuous way, which means that this zone can be fully used as fastening and contact zone.

The fastening means of the individual contact segments, which may e.g. be centrally mounted, have recesses into which the conductive cover elements may be inserted in a simple manner. In general, contact segment and cover element are made of the same material which is pressure-resistant, highly conductive and, preferably, also resistant to high temperatures. However, it may also be desirable to use cover elements of a less conductive material (as compared to that used for the contact zones proper) in order to prevent them from becoming the preferred current paths in case of arcing.

In accordance with a preferred embodiment of the invention the electrode holder has at least two contact zones in the upper part of the sheath area, whereby the central points of two contact segments being axially aligned one beneath the other have a distance of approximately 0.5 m to 0.9 m from each other.

In certain cases it may also be preferable to fill the junctions between the sheath area of the electrode holder and the segements forming the contact zones with mastic. Suitable sealing materials are known, carbon-containing materials are good examples.

The electrode holder in accordance with the present invention is capable of receiving the electric current over a considerable part of its metallic sheath area, whereby the two functions of current supply and mechanical fastening of the electrode holder are generally combined. As a result, the internally cooled metal shaft of the electrode holder may be exposed to considerable pressing powers, and it has therefore proved to be especially advantageous to brace the electrode holder, at least in the area of the contact zones, with internal, mechanically resistant braces which counteract any mechanical deformation of the electrode holder by fastening means or current supply elements. These braces may e.g. be high-strength pipes, steel bars, etc., which are secured to the internal cooling pipes, i.e. to either the feed pipe or the return pipe or both of them. The braces may essentially reach as far as the internal sheath area of the metal shaft. By mounting the braces of high-strength, hard material it is possible to compensate for the mechanically less impressive properties of the highly conductive copper or copper alloys, which are usually used for the sheath of the electrode holder.

In accordance with a preferred embodiment of the invention, the lower part of the electrode holder which is adjacent to the contact zones is surrounded by high-temperature resistant protective elements. These elements protect the electrode holder above all against heat which would make the holder metal melt. Such a heat accumulation is the result of slag splashes inside the furnace arcing short circuits caused by other reasons, or general environment temperature. The protective elements are preferably of high-temperature resistant, conductive material. In accordance with a preferred embodiment of the invention two wide, axially offset contact zones in the lower part of the electrode holder are followed by a number of protective segments whose fastening means may be covered by conductive coverings, with the last protective ring on the lower end of the electrode holder being directly screwed down on the sheath by means of an internal thread. With regard to the design of protective elements or protective segments reference is made to copending U.S. application Ser. No. 342,813, the respective passages of which shall herewith be considered part of this text.

It is also possible to use high-temperature resistant, deformable or elastic intermediate materials between the protective segments attached in the lower part of the electrode holder and the sheath area of the internally cooled metal shaft. For this purpose electrically conductive materials such as graphite foil or graphite fleece are preferred. It is, however, also possible to use less conductive materials, such as ceramic paper. In accordance with a special embodiment of the invention copper tissues, copper strand, etc. may also be used as intermediate material.

In some embodiments of the invention it has proved favourable that the contact zones on the one hand and the protective elements on the other are basically flush, in order to provide an optimal movability of the electrode holder.

The employment of the electrode holder in accordance with the invention has numerous advantages. The most important one is, that by changing the clamping position on the electrode holder too frequent nippling operations which cause an interruptions of the electric-arc furnace operations can be avoided. Furthermore, the electrode holder in accordance with the invention enables the user to employ graphite electrodes of normal length as active parts. Having a length of approximately 1.8 m to 2.2 m, they may be attached to the remaining parts of the electrode used before which may be 04. m to 08. m long.

The electrode holder in accordance with the invention is intended for use in the production of the electric steel in electric-arc furnaces. The active materials used are, therefore, generally carbon materials, particularly graphite.

BRIEF DESCRIPTION OF THE DRAWINGS

Some embodiments of the invention are illustrated in the accompanying figures in which.

DETAILED DESCRIPTION OF THE DRAWINGS

Figure 1:
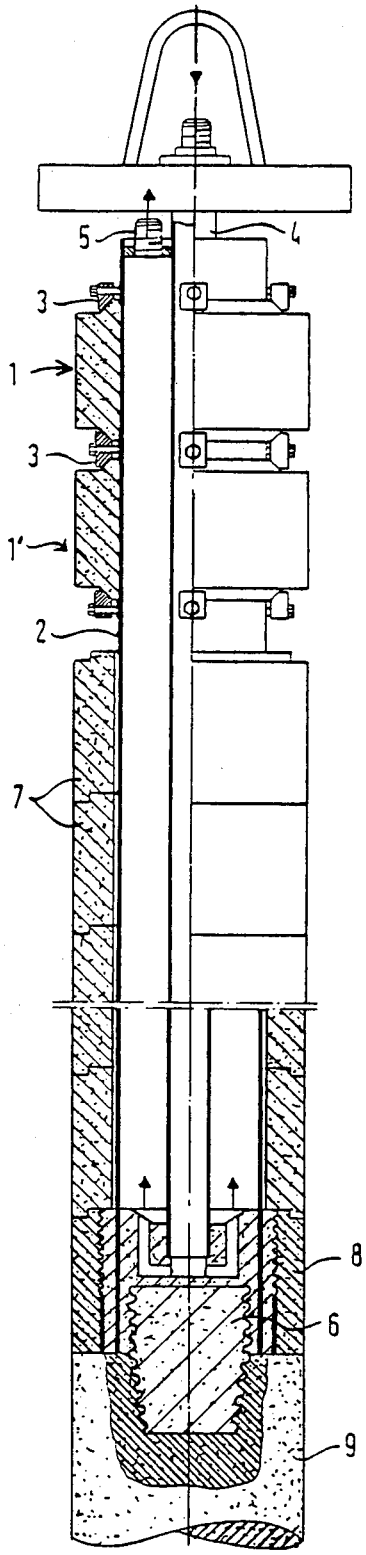
FIG. 1 is a side elevational view in cross section of the electrode holder.

FIG. 1 clearly shows the contact zones 1 and 1' surrounding the sheath area 2 of the electrode holder. The two separate contact zones are axially offset and affixed to the sheath area 2 by fastening plates 3, which are located at the top in between and at the bottom of the contact zones. Within the electrode holder there are cooling pipes for the supply and discharge of the cooling medium which may be water, gas such as air, argon, but also liquid metal (e.g. sodium). The lower part of the electrode holder is characterized by protective segments 7, with the last protective segment 8 being screwed to the sheath area 2 of the metal shaft by means of an internal thread. The electrode holder is secured to the active part 9 by a threaded nipple 6.

Figure 2:
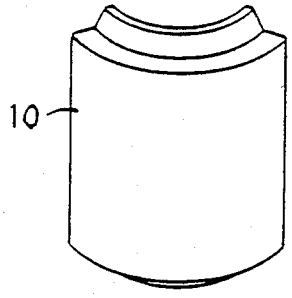
FIG. 2 is a perspective view of an individual segment several of which may make up a contact zone.
Figure 3:
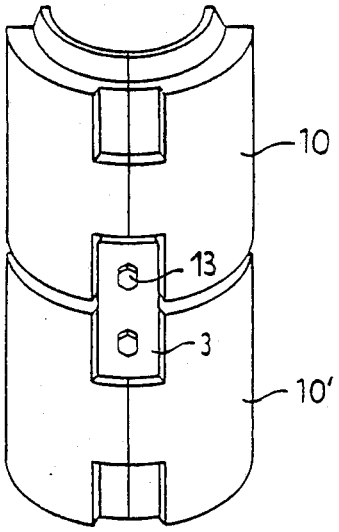
FIGS. 3 and 4 are illustrations of different fastening means of the segments.

FIG. 2 is a perspective view of an individual segment 10, which is utilized in making up contact zones 1 and 1' and FIG. 3 shows two of these segments 10 and 10' which are arranged and fastened by means of a plate 3 which is fixed to the electrode holder by two screws 13.

Figure 4:
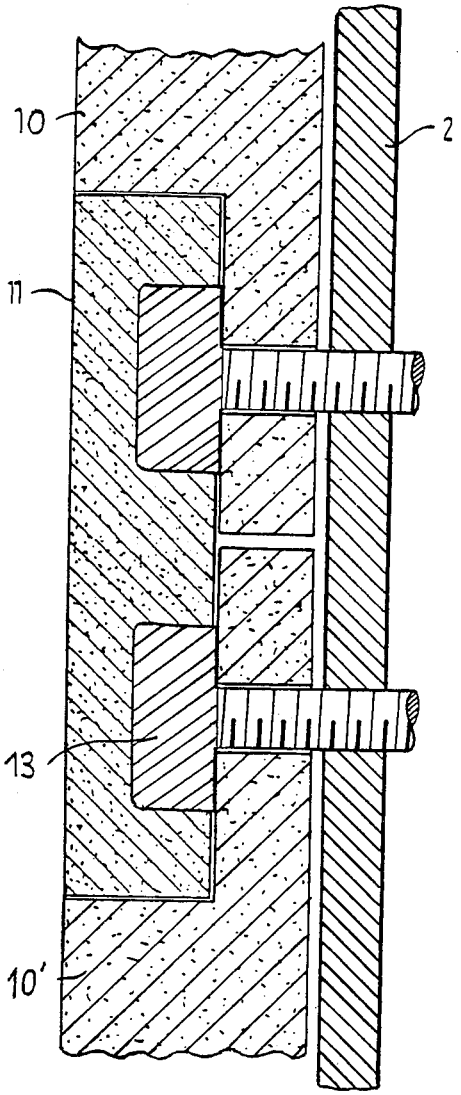

FIG. 4 illustrates the arrangement of coverings 11 on the fastening screws 13. As a rule, the material preferred for coverings is less electrically conductive than that used for the protective elements in order to avoid a preferred current path along the screws 13, in case of a short circuit.

We claim:

1. In an axially movable metallic electrode holder having a threadable interconnection means for attaching active electrode parts of consumable material to the electrode holder, and a cooling means having a supply and a return coolant conduit pipe, and at least one contact means by which the electrode holder is mechanically engaged by clamping jaws and thereby electrically connected to a supply of electrical current, the improvement comprising the contact arrangement having at least an uppermost and a lowermost contact zone of a pressure-resistant material, each contact zone having an axial dimension sufficient to receive the clamping jaws, whereby a distance between the uppermost and the lowermost contact zone corresponds to at least a portion of an allowable length of consumption of the active electrode parts.

2. The electrode holder as set forth in claim 1 including a continuous sequence of discreet contact zones between the uppermost and lowermost.

3. The electrode holder as set forth in any one of claims 1 and 2 wherein said contact zones constitute rings of highly conductive material resting against the metal sheath area.

4. The electrode holder as set forth in claim 3 wherein said contact zones are formed from at least one segment.

5. The electrode holder as set forth in claim 4 wherein said contact zones are made of highly conductive graphite.

6. The electrode holder as set forth in claim 5 wherein said contact zones are arranged to allow the electrical current to be supplied over a zone encompassing approximately the upper third of the electrode holder.

7. The electrode holder as set forth in claim 5 wherein said contact zones are arranged to allow the electrical current to be supplied over a zone encompassing approximately the upper half of the electrode holder.

8. The electrode holder as set forth in claim 1 including means for fastening said contact segments to the electrode, the fastening means including conductive coverings.

9. The electrode holder as set forth in claim 8, the electrode including an outer sheath having junctions between the sheath and the segments forming the contact zones, the function being filled with a mastic.

10. The electrode holder as set forth in claims 1 or 3, the contact segments having each a central point the points being axially aligned, and to a distance of approximately 0.5 m to 0.9 m each from the other.

11. The electrode holder as set forth in claim 10, wherein said contact zones encompass approximately 0.6 m to 2.0 m linearly of the upper part of the electrode holder.

12. The electrode holder as set forth in claims 1 or 3, at least in the area of the contact zones including internal, mechanically resistant bracings configured to counteract a mechanical deformation of the electrode holder by the fastening means and the contact means.

13. The electrode holder as set forth in claim 12 wherein the bracings are fastened to the interal cooling conduit pipes.

14. The electrode holder as set forth in claims 1 or 3 including a plurality of high-temperature resistant protective segments arranged surrounding portions of said electrode holder not engaged by the contact means.

15. The electrode holder as set forth in claim 14 wherein said protective segments are made of electrically conductive material.

16. The electrode holder as set forth in claim 15 wherein at least a lowermost protective segment upon the electrode holder is secured by a fastener to the electrode holder.

17. The electrode holder as set forth in claim 15 a high-temperature resistant, intermediate material being placed between the protective segments and the electric holder.

18. The electrode holder as set forth in claim 17 wherein the intermediate material comprises one of graphite foil, graphite fleece, ceramic paper and copper strand.

19. The electrode holder as set forth in claim 14 wherein said contact zones and said protective segments are essentially flush.

* * * * *

UNITED STATES PATENT AND TRADEMARK OFFICE

CERTIFICATE OF CORRECTION

PATENT NO. : 4,446,561

DATED : May 1, 1984

INVENTOR(S) : Zöllner et al

It is certified that error appears in the above-identified patent and that said Letters Patent are hereby corrected as shown below:

In the ABSTRACT, line 7, before "its", insert --in--.

In the ABSTRACT, line 14, delete the word "too" and insert --to--.

In Claim 13, line 54, delete the word "interal" and insert --internal--.

Signed and Sealed this

Fourth Day of September 1984

[SEAL]

*Attest:*

GERALD J. MOSSINGHOFF

*Attesting Officer*

*Commissioner of Patents and Trademarks*